US007617879B2

(12) United States Patent
Anderson et al.

(10) Patent No.: US 7,617,879 B2
(45) Date of Patent: Nov. 17, 2009

(54) CASING SHOE

(75) Inventors: Kenneth Anderson, Duncan, OK (US); George York, Grand Junction, CO (US)

(73) Assignee: Halliburton Energy Services, Inc., Duncan, OK (US)

( * ) Notice: Subject to any disclaimer, the term of this patent is extended or adjusted under 35 U.S.C. 154(b) by 162 days.

(21) Appl. No.: 11/559,503

(22) Filed: Nov. 14, 2006

(65) Prior Publication Data

US 2008/0110636 A1 May 15, 2008

(51) Int. Cl.
*E21B 17/14* (2006.01)

(52) U.S. Cl. ..... 166/386; 166/327; 166/242.4; 166/242.8

(58) Field of Classification Search ..... 166/327, 166/242.4, 242.8, 386, 285
See application file for complete search history.

(56) References Cited

U.S. PATENT DOCUMENTS 1,526,581 A * 2/1925 Bache ..... 166/327
1,811,885 A * 6/1931 Hill ..... 166/327
4,712,619 A 12/1987 Stepp et al.
5,379,835 A 1/1995 Streich
5,472,053 A 12/1995 Sullaway et al.
5,542,483 A * 8/1996 Edman ..... 175/257
5,647,434 A 7/1997 Sullaway et al.
5,697,442 A 12/1997 Baldridge
5,839,519 A * 11/1998 Spedale, Jr. ..... 175/57
5,964,297 A * 10/1999 Edman ..... 166/380
6,047,997 A * 4/2000 Olivier ..... 285/333
6,089,068 A * 7/2000 Kato et al. ..... 72/199
6,120,067 A * 9/2000 Mosing et al. ..... 285/333
6,244,342 B1 6/2001 Sullaway et al.
6,485,063 B1 * 11/2002 Olivier ..... 285/333
6,497,291 B1 12/2002 Szarka
6,810,958 B2 * 11/2004 Szarka et al. ..... 166/285
6,820,695 B2 * 11/2004 Stevens et al. ..... 166/327
7,077,197 B2 * 7/2006 Harrall ..... 166/242.1
7,182,156 B2 * 2/2007 Charland et al. ..... 175/257
7,357,181 B2 * 4/2008 Webb et al. ..... 166/285
7,395,882 B2 * 7/2008 Oldham et al. ..... 175/402
2002/0148615 A1 * 10/2002 Szarka et al. ..... 166/332.4

(Continued)

OTHER PUBLICATIONS

"Trophy Seal™ Floating Equipment, Cementing," Halliburton Fluid Systems, 2005, 2 pgs.

(Continued)

*Primary Examiner*—Shane Bomar
(74) *Attorney, Agent, or Firm*—John W. Wustenberg; Conley Rose, P.C.

(57) ABSTRACT

A casing shoe for a casing string that includes an annular body. The annular body includes an annular recess that forms an outer portion and an inner portion, the inner portion forming and extending into an inner bore. The annular recess can accept an end of the casing string such that the casing string extends between the inner and outer portions. The annular body includes a homogenous material. The casing shoe is used in a method of guiding a casing string into a wellbore where the casing shoe is attached to an end of the casing string. Attaching the casing string includes inserting the end of the casing string into the annular recess such that the casing string extends between the inner and outer portions. The casing string is then inserted into the wellbore.

24 Claims, 4 Drawing Sheets

U.S. PATENT DOCUMENTS

| | | | | |
|---|---|---|---|---|
| 2003/0116320 | A1* | 6/2003 | Szarka et al. | 166/291 |
| 2003/0190216 | A1* | 10/2003 | Livingston | 411/403 |
| 2006/0272827 | A1* | 12/2006 | Adam et al. | 166/380 |
| 2008/0238094 | A1* | 10/2008 | Craig et al. | 285/331 |

OTHER PUBLICATIONS

"Trophy Seal® Float Shoes and Collars," Halliburton, http://www.halliburton.com/ps/printerfriendly.aspx?navigation_id=83&product_id=MSE::105535977449 . . . , Aug. 16, 2006. 1 pg.

* cited by examiner

CASING SHOE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not applicable.

BACKGROUND

In the oil and gas exploration industry, the process of cementing casing into the wellbore of an oil or gas well generally comprises several steps. For example, a section of a hole or wellbore is drilled with a drill bit which is slightly larger than the outside diameter of the casing which will be run into the well. Next, after drilling the well to the desired depth, the drillpipe is removed and a string of casing is run into the wellbore to the required depth where the casing lands in and is supported by a well head. When run in, the casing string is typically supported by the derrick of the drilling rig used to drill the wellbore. The casing string typically has a bottom assembly attached to it, such as a guide shoe or a float shoe, that guides the casing string into the borehole. At this time, the drilling mud (used to remove formation cuttings during the drilling of the well) is still in the borehole. For the casing to be cemented in place, this mud must be removed and replaced by hardened cement.

For the cementing operations, cement slurry is pumped into the casing to fill the annulus between the casing and the wellbore. The cement passes out of apertures in the shoe and into the annulus between the borehole and the casing. The drilling mud is displaced upwards and the cement replaces it in the annulus. The cement needs to extend at least as far up the annulus so as to cover the production and/or water zones, and the previous casing shoe if present, and sometimes the cement even extends to the surface. The cement serves to secure the casing in position and prevent migration of fluids and gasses between formations through which the casing has passed. Once the cement hardens, a smaller drill bit is used to drill through the cement in the shoe joint and further into the earth.

Guide shoes typically comprise a tapered, often bullet-nosed piece of equipment found on the bottom of a casing string. The shoe guides the casing toward the center of the hole and minimizes problems associated with hitting rock ledges or washouts in the wellbore as the casing string is lowered into the well. The outer portions of the guide shoe are typically made from steel, generally matching the casing string in size, if not steel grade. The interior is generally made of cement or thermoplastic, since this material must be drilled out if the well is to be deepened beyond its current casing point. However, the interior may also be made of only steel.

Float shoes also typically include a tapered, often bullet-nosed device fitted with a valve and are typically found at the bottom of a casing string. The float shoe prevents reverse flow, or U-tubing, of cement slurry from the annulus into the casing. The float shoe also guides the casing toward the center of the hole to minimize hitting rock ledges or washouts as the casing is run into the wellbore. The float shoe also reduces hook weight. The outer portions of the float shoe are typically made of steel and generally match the casing size, although not necessarily the casing grade. The interior is usually made of cement or thermoplastic, since this material must be drilled out if the well is to be deepened beyond its current casing point.

Guide shoes differ from float shoes in that they lack the valve that float shoes have for preventing reverse flow into the interior of the casing string. Thus, depending on the specific operation needs for a well, a well operator must specify whether to use a guide shoe or a float shoe to facilitate running the casing in the borehole. The inclusion of a valve increases the manufacturing and consumer cost of a float shoe. Therefore, some operators specify guide shoes based on cost savings if the performance is appropriate. Thus, manufacturers typically manufacture and keep both guide shoes and float shoes in inventory for servicing either type of casing installation.

An additional concern with shoes having cement interior portions is the structural integrity of the shoe during storage, transportation, and use. If the cement is subjected to enough stress, the cement may crack, chip, or break, damaging the shoe and potentially rendering the shoe useless.

SUMMARY OF THE INVENTION

Disclosed herein is a casing shoe for a casing string, comprising an annular body comprising an annular recess forming an outer portion and an inner portion, the inner portion forming and extending into an inner bore, and the annular recess adapted to accept an end of the casing string such that the casing string extends between the inner and outer portions, and wherein the annular body comprises a homogenous material.

Also disclosed herein is a casing shoe for a casing string, the casing shoe comprising an annular body comprising a single piece of homogenous material.

Also disclosed herein is a method of guiding a casing string into a wellbore, the method comprising attaching a casing shoe to an end of the casing string, the casing shoe comprising an annular body comprising an annular recess forming an outer portion and an inner portion, the inner portion forming and extending into an inner bore, the body comprising a single piece of homogenous material, wherein attaching the casing shoe comprises inserting the end of the casing string into the annular recess such that the casing string extends between the inner and outer portions, and inserting the casing string into the wellbore.

Further disclosed herein is a method of guiding a casing string into a wellbore, the method comprising attaching a casing shoe comprising an annular body comprising a single piece of homogenous material to an end of the casing string, and inserting the casing string into the wellbore.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
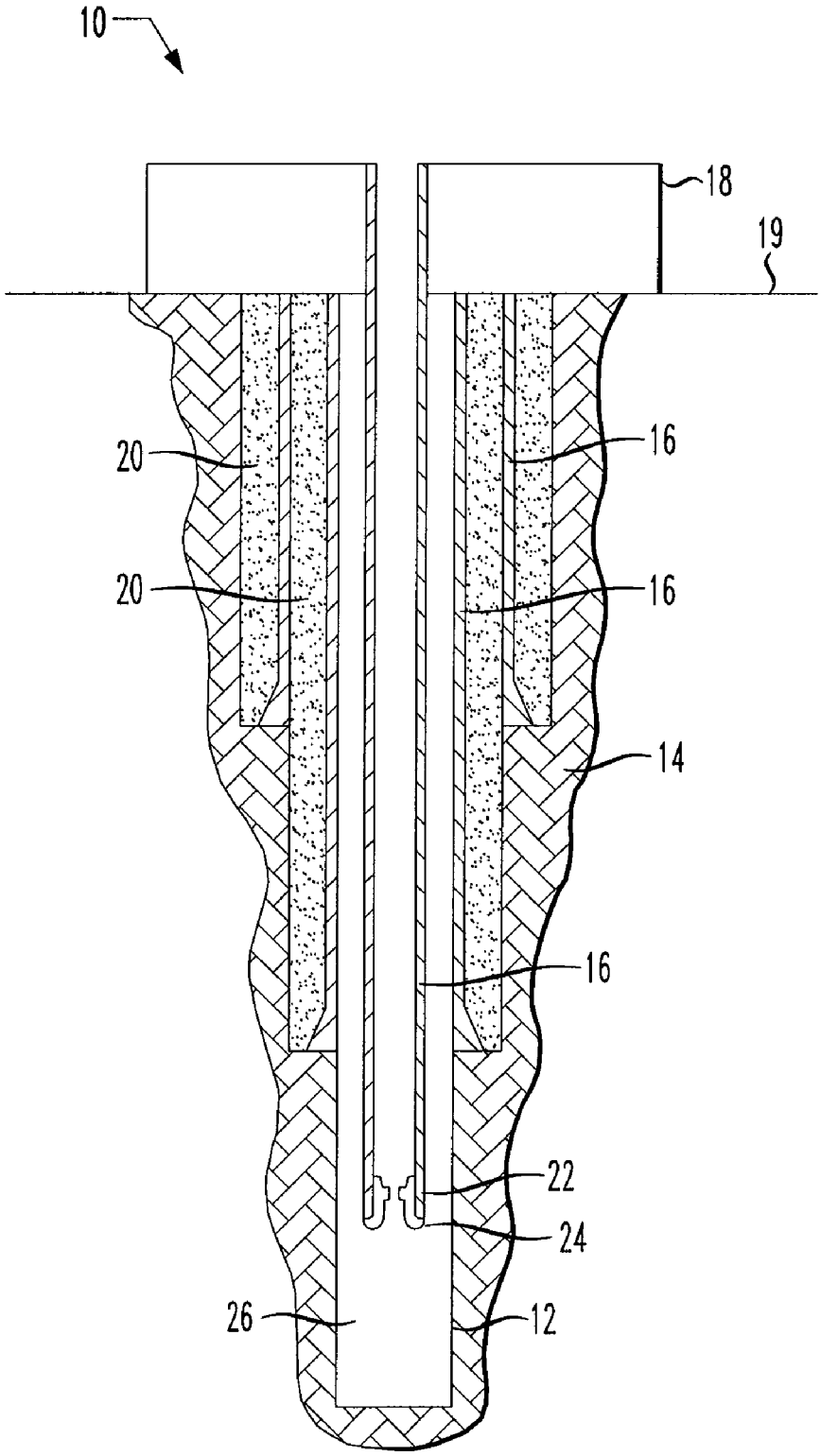
FIG. 1 is a schematic drawing of a well system.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. The various characteristics mentioned above, as well as other features and characteristics described in more detail below, will be readily apparent to those skilled in the art upon reading the following detailed description of the embodiments, and by referring to the accompanying drawings.

Figure 2:
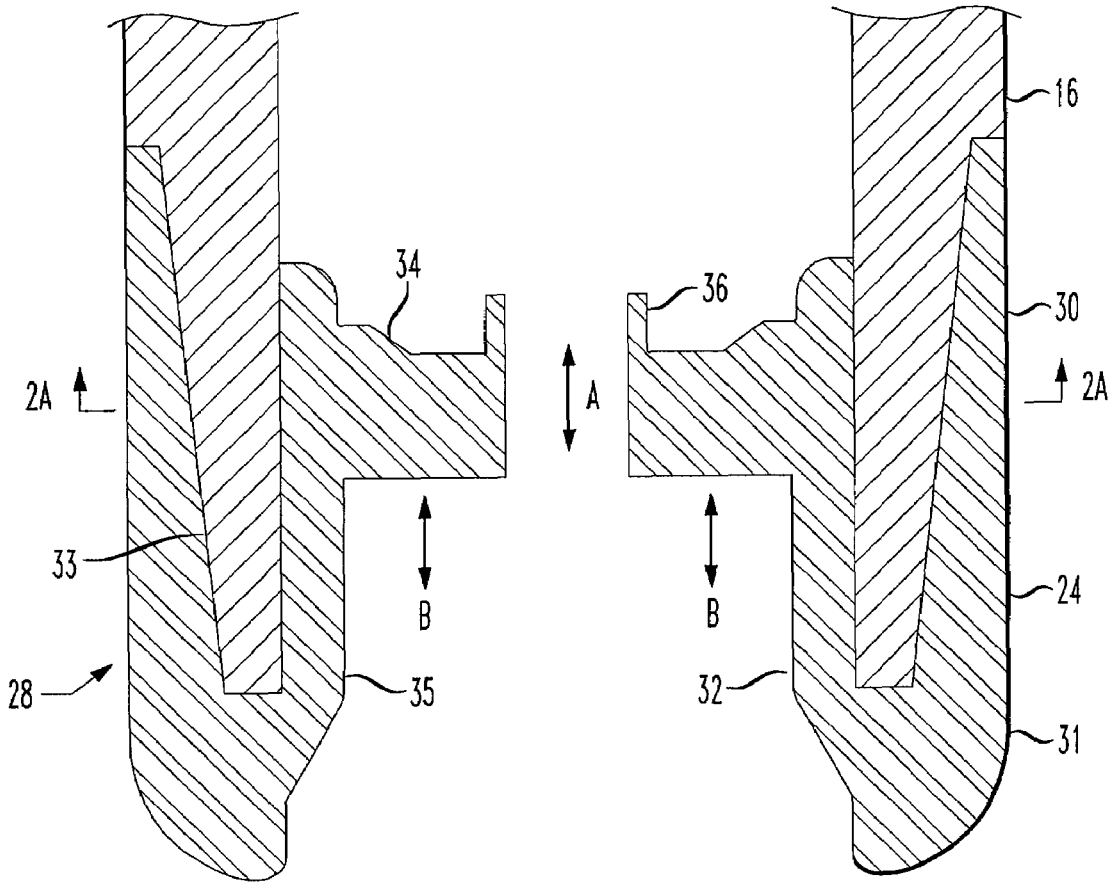
FIG. 2 is a cross-section of a guide shoe embodiment of a casing shoe.
Figure 3:
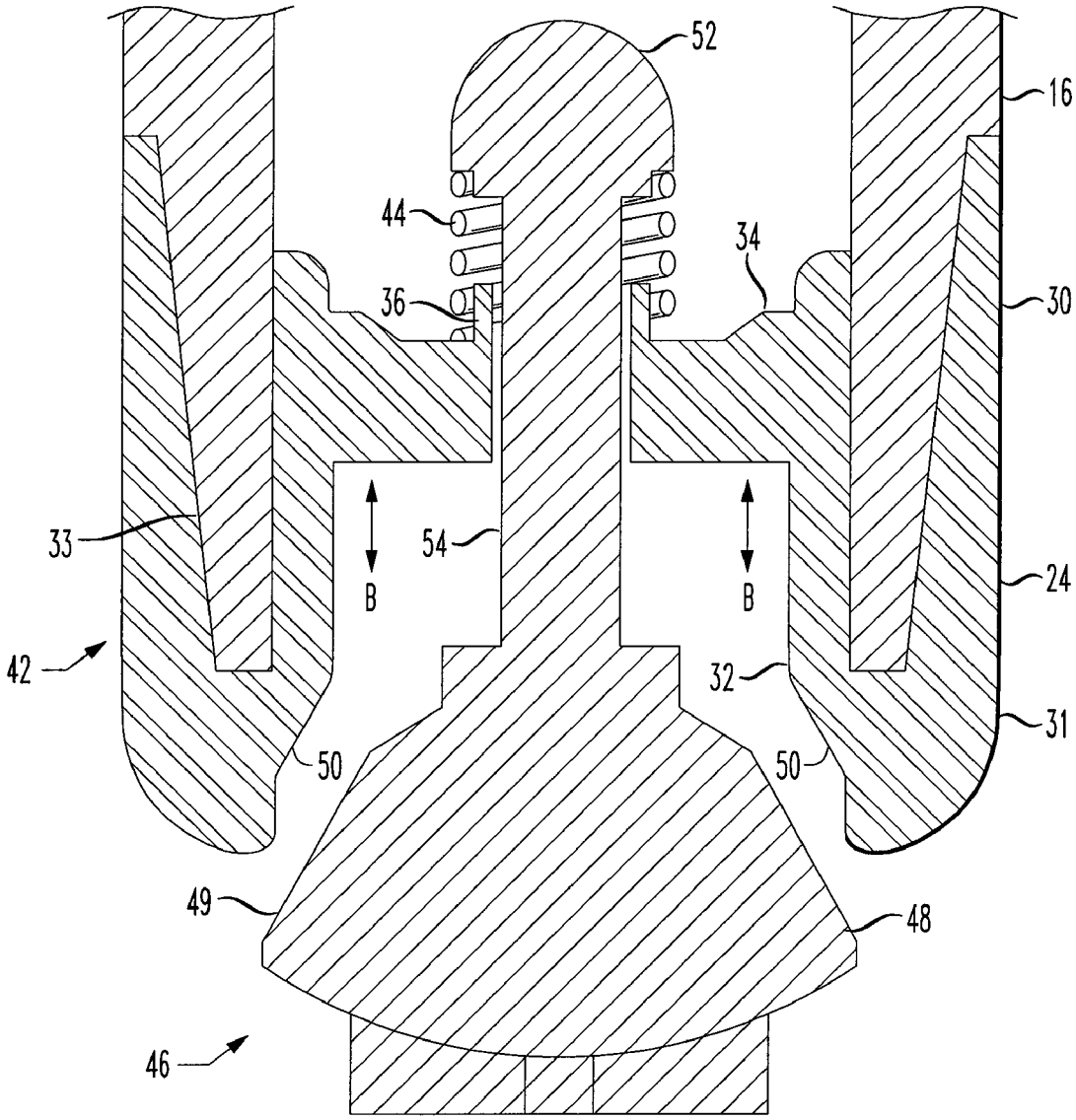
FIG. 3 is a cross-section of a float shoe embodiment of the casing shoe.

In the embodiments illustrated in FIGS. 1-3, a casing shoe 24 is used to run a casing string 16 into a well 10, which includes a wellbore 12 extending through a formation 14. The well 10 may also include previously installed casing strings 16 set with cement 20. The casing shoe 24 is attached to the terminal end 22 of the casing string 16 and the casing string 16 is then lowered through the well head 18 on the Earth's surface 19 into the wellbore 12. The casing string 16 may be supported with the derrick of the drilling rig used to drill the wellbore 12. Once installed, the casing string 16 stabilizes and isolates at least the uncased portion 26 of the formation 14. After installation, the casing shoe 24 typically is cemented in place with the casing string 16, but may also be retrieved from the wellbore 12 if desired. If left downhole, the casing shoe 24 may be drilled-though if the wellbore 12 is extended further.

Figure 2A:
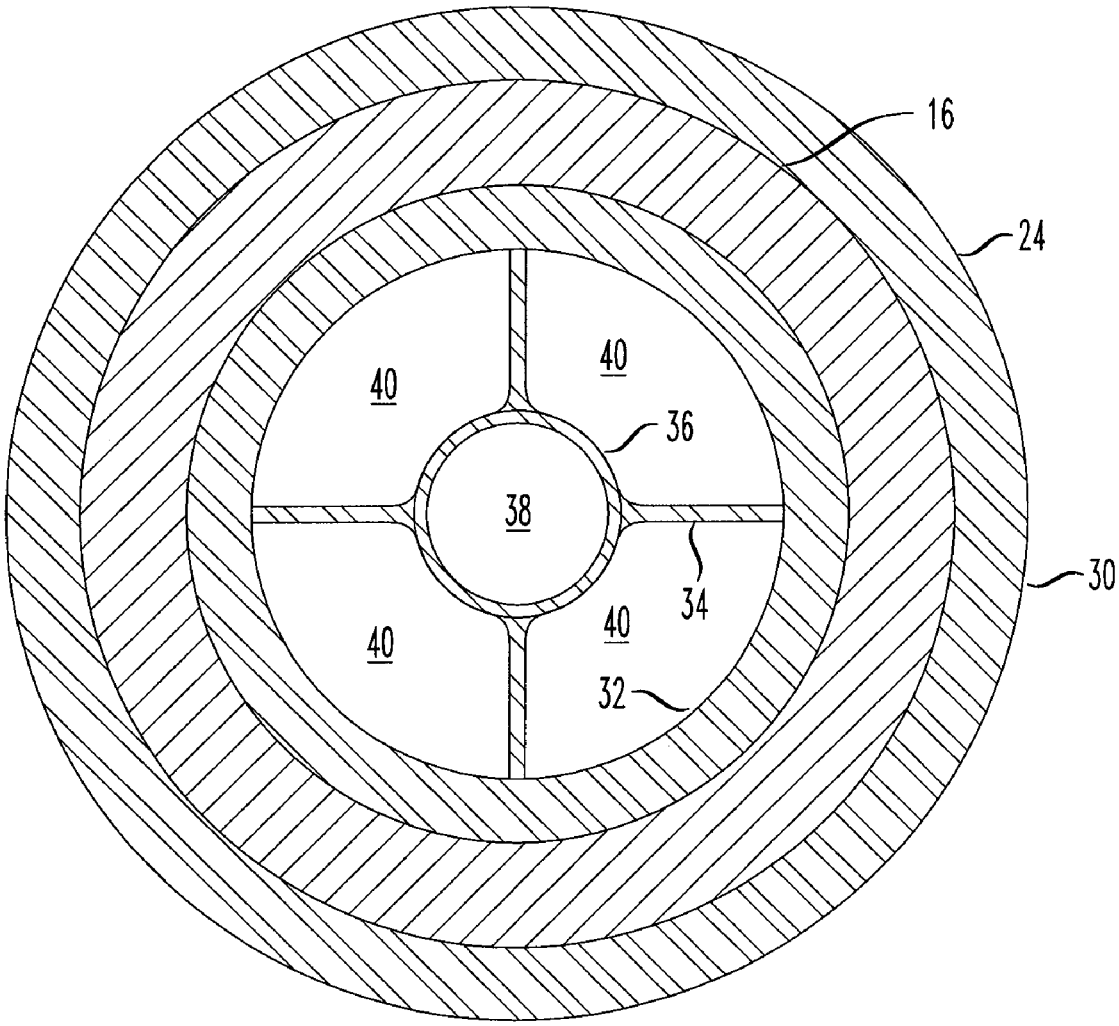
FIG. 2A is a cross-section of the casing shoe shown in FIG. 2 taken at plane 2A.

FIGS. 2 and 2A illustrate an embodiment of the casing shoe 24 in the form of a guide shoe 28. The guide shoe 28 comprises an annular body 31 with an annular recess 33 extending partially through the body 31 and forming an outer portion 30 and an inner portion 32. The inner portion 32 extends into an inner bore 35 of the guide shoe 28. As shown, the terminal end 22 of the casing string 16 extends into the annular recess 33 between the inner portion 32 and outer portion 30. As such an inner and outer lower portion of the terminal end 22 of the casing string 16 is covered and thereby protected by the guide shoe 28. The guide shoe 28 may attach to the casing string 16 by any suitable means, such as a threaded engagement, interference fit, or adhesive bond.

The inner portion 32 further comprises at least one inner spoke 34 that extends into the inner bore 35. Although FIGS. 2 and 2A illustrate there being four inner spokes 34, there may an alternative number of spokes, for example one, two, three, four, or more inner spokes 34. The inner spokes 34 support an inner collar 36. As illustrated in FIG. 2A, the inner collar 36 forms an inner collar flow path 38 and the spokes 34 form spoke flow paths 40.

The guide shoe annular body 31, which includes outer portion 30, inner portion 32, inner spokes 34, and inner collar 36, comprises a homogenous material. Additionally, the homogenous material is non-metal. The homogenous material may also be non-steel and non-cement. For example, the annular body 31 may be made of a plastic. The plastic may be any type of plastic suitable for downhole use. For example the plastic may be suitable for downhole environments where ambient temperatures may reach in excess of about 200 degrees Fahrenheit. In an embodiment, the guide shoe annular body 31, which includes outer portion 30, inner portion 32, inner spokes 34, and inner collar 36 comprises a thermoplastic material. Herein a thermoplastic material is a material that is plastic or deformable, melts to a liquid when heated and freezes to a brittle, glassy state when cooled sufficiently. Thermoplastic materials are known to one of ordinary skill in the art and include for example and without limitation polyaryletherketones, polybutenes, nylons or polyamides, polycarbonates, thermoplastic polyesters such as those comprising polybutylene terephthalate and polyethylene terephthalate; polyphenylene sulphide; polyvinyl chloride; styrenic copolymers such as acrylonitrile butadiene styrene, styrene acrylonitrile and acrylonitrile styrene acrylate; polypropylene; thermoplastic elastomers; aromatic polyamides; cellulosics; ethylene vinyl acetate; fluoroplastics; polyacetals; polyethylenes such as high-density polyethylene, low-density polyethylene and linear low-density polyethylene; polymethylpentene; polyphenylene oxide, polystyrene such as general purpose polystyrene and high impact polystyrene or combinations thereof.

Alternatively the guide shoe annular body 31, which includes outer portion 30, inner portion 32, inner spokes 34, and inner collar 36 comprises a thermoset material such as a thermosetting plastic. Herein a thermosetting plastic is a polymer material that cures, through the addition of energy, to a stronger form. The energy may be in the form of heat (generally above 200° C.), through a chemical reaction or irradiation. Examples of thermosetting plastics include for example and without limitation unsaturated polyesters; alkyds; allylics; epoxides; furans; mealmines; phenolics; polyurethane cast elastomers and vinyl esters. These materials may be formed by one of ordinary skill in the art using a plastics shaping process such as injection molding to produce the disclosed devices.

The annular body 31 is also manufactured by any suitable means. For example, the annular body 31 may be formed by injection molding, thermal casting, thermal molding, extrusion molding, and/or any combination of these methods. The annular body 31, while being a homogenous material, need not necessarily be formed as a single, integral piece. However, the annular body 31 may be a single, integral piece if desired.

At the surface 19, the guide shoe 28 is installed on the terminal end 22 of the casing string 16, the terminal end 22 of the casing string 16 being inserted into the annular recess 33. The guide shoe 28 may be attached on the casing string 16 using threads that engage threads on the casing string 16. Alternatively, the guide shoe 28 may be attached simply using an interference fit or any other suitable method of attaching the guide shoe 28 to remain attached during the running in of the casing string 16. The casing string 16 is then inserted into the wellbore 12 through the well head 18, typically in sections. As the casing string terminal end 22 is run into the wellbore 12, the guide shoe 28 guides the casing string 16, assisting the casing string 16 in moving through the wellbore 12. Sections of the casing string 16 continue to be added until the casing string 16 reaches its installation depth. After installation depth is reached, cementing operations may be performed to complete the installation of the casing string 16 and isolate the previously uncased portion 26 of the wellbore 12. As the casing string 16 runs into the wellbore 12, the guide shoe 28 contacts the previously installed casing string as well as the uncased portion 26 of the wellbore 12, subjecting the guide shoe 28 to impact stresses. To add structural integrity to the guide shoe 28, the casing string 16 extends into the annular recess 33.

When the casing string 16 is run in, the wellbore 12 is typically filled with wellbore fluids, such as drilling fluid used when drilling through the formation 14. The inner bore 35 of the guide shoe 28 is open to the flow of fluids through the guide shoe 28 and into the interior of the casing string 16. Fluids flow through the guide shoe 28 by flowing through the inner collar flow path 38 shown by multi-direction arrow A in FIG. 2. Fluids also flow through the inner spoke flow paths 40 as shown by multi-direction arrows B in FIG. 2. Fluid flow is not limited to flow into the interior of the casing string 16, however. Fluid may also flow from the interior of the casing string 16 out into the wellbore 12, such as when performing cementing operations.

Once the casing string 16 is installed, cementing operations may commence. The cement slurry is pumped downwardly through the casing string 16, out the guide shoe 28, and into the annulus between the casing string 16 and the uncased portion 26 of the wellbore 12. The drilling fluid is displaced upwards and the cement replaces it in the annulus. The cement may extend up as far as desired, sometimes even extending to the surface. The cement secures the casing string 16 in position and prevents migration of fluids and gasses between formations through which the casing has passed.

FIG. 3 illustrates another embodiment of the casing shoe 24 in the form of a float shoe 42. The float shoe 42 comprises similar structure to the guide shoe 28 discussed above and like parts are given the same reference numerals. Similar to the guide shoe 28, the float shoe 42 also comprises an annular body 31 with an annular recess 33 extending partially through the body 31 and forming an outer portion 30 and an inner portion 32. The inner portion 32 extends into an inner bore 35 of the float shoe 42. As shown, the terminal end 22 of the casing string 16 extends into the annular recess 33 between the inner portion 32 and outer portion 30. As such an inner and outer lower portion of the terminal end 22 of the casing string 16 is covered and thereby protected by the float shoe 42. The float shoe 42 may attach to the casing string 16 by any suitable means, such as a threaded engagement, interference fit, or adhesive bond.

The inner portion 32 further comprises at least one inner spoke 34 that extends into the inner bore 35. There may be one or more inner spokes 34, for example one, two, three, four or more inner spokes 34. The inner spokes 34 support an inner collar 36. Similar to the guide shoe 28, the spokes 34 form spoke flow paths 40.

Unlike the guide shoe 28, the float shoe 42 further comprises a valve member 46 and a spring 44. The valve member 46 comprises a plunger 48, a valve stem 54, and a cap 52. Although FIG. 3 illustrates the valve member 46 as being one piece, the plunger 48, valve stem 54, and cap 52 may also be separate pieces that are connected, for example, by threads or any other suitable means. The valve stem 54 extends through the inner collar 36 and comprises a first end engaged with the plunger 48 and a second end engaged with the cap 52. The float shoe body inner portion 32 further comprises a downwardly facing valve seat 50. The valve seat 50 may be of any suitable configuration, such as frustoconical in shape. The plunger 48 includes a corresponding seal surface 49 of matching configuration with the valve seat 50. An example of a suitable float valve configuration is contained in the TROPHY SEAL® float collar that is commercially available from Halliburton Energy Services, Inc.

The spring 44 comprises a first end overlapping the inner collar 36 and a second end retained by the cap 52. The spring 44 biases the seal surface 49 of the plunger 48 into sealing engagement with the valve seat 50. The spring 44 may be made of any suitable material, for example, metal, such as aluminum or phosphor bronze. The spring 44 biases the plunger 48 by resting on the inner spokes 34 that support the inner collar 36. The spring 44 is maintained on the valve stem 54 by the cap 52 that has an annular flange extending outwardly beyond the exterior diameter of the spring 44.

Similar to the guide shoe 28, the float shoe annular body 31, which includes outer portion 30, inner portion 32, inner spokes 34, and inner collar 36, comprises a homogenous material. Additionally, the homogenous material is non-metal. The homogenous material may also be non-steel and non-cement. For example, the annular body 31 may be made of a plastic. The plastic may be any type of plastic suitable for downhole environments where ambient temperatures may reach in excess of about 200 degrees Fahrenheit such as the thermoplastics and thermosetting plastics described previously herein. The annular body 31 is also manufactured by any suitable means. For example, the annular body 31 may be formed by injection molding, thermal casting, thermal molding, extrusion molding, and/or any combination of these methods. The annular body 31, while being a homogenous material, need not necessarily be formed as a single, integral piece. However, the annular body 31 may be a single, integral piece if desired.

Additionally, the valve member 46 comprises a homogenous material. Although possible, the valve member 46 need not necessarily be the same material as the annular body 31. Similarly, the homogenous material of the valve member 46 is non-metal. The homogenous material may also be non-steel and non-cement. For example, the valve member 46 may be made of a plastic. The plastic may be any type of plastic suitable for downhole environments where ambient temperatures may reach in excess of about 200 degrees Fahrenheit such as the thermoplastics and thermosetting plastics described previously herein. The valve member 46 is also manufactured by any suitable means. For example, the valve member 46 may be formed by at least one of injection molding, thermal casting, thermal molding, extrusion molding, and/or any combination of these methods. The valve member 46, while being a homogenous material, need not necessarily be formed as a single, integral piece. However, the valve member 46 may be a single, integral piece if desired.

At the surface 19, the float shoe 42 is installed on the terminal end 22 of the casing string 16, with the terminal end 22 of the casing string 16 being inserted into the annular recess 33. The float shoe 42 may be attached on the casing string 16 using threads that engage threads on the casing string 16. Alternatively, the float shoe 42 may be attached simply using an interference fit or any other suitable method of attaching the float shoe 42 to remain attached during the running in of the casing string 16. The casing string 16 is then inserted into the wellbore 12 through the well head 18, typically in sections. As the casing string terminal end 22 is run into the wellbore 12, the float shoe 42 guides the casing string 16, assisting the casing string 16 in moving through the wellbore 12. Sections of the casing string 16 continue to be added until the casing string 16 reaches its installation depth. After installation depth is reached, cementing operations may be performed to complete the installation of the casing string 16 and isolate the previously uncased portion 26 of the wellbore 12. As the casing string 16 runs into the wellbore 12, the float shoe 42 contacts the previously installed casing string as well as the uncased portion 26 of the wellbore 12, subjecting the float shoe 42 to impact stresses. To add structural integrity to the float shoe 42, the casing string 16 extends into the annular recess 33.

When the casing string 16 is run in, the wellbore 12 is typically filled with wellbore fluids, such as drilling fluid used when drilling through the formation 14. Unlike the guide shoe 28, the spring 44 biases the float shoe 42 closed to the flow of fluids through the float shoe 42 and into the interior of the casing string 16. Thus, the float shoe 42 prevents fluid flow through the float shoe 42 and into the casing string 16. In addition to the spring 44, fluid pressure on the outside of the valve plunger 48 as the casing string 16 is run into the wellbore 12 also provides sealing force to seal the plunger 48 against the valve seat 50. Thus, during installation and prior to the commencement of cementing flow, the valve member 46 provides a tight seal, which prevents the entry of wellbore fluids into the casing string 16 from below. As the casing string 16 is run in, the float shoe 42 provides an empty and therefore buoyant casing string 16 that may be literally "floated" in the wellbore fluids down into the wellbore 12, thus relieving stress on the casing string 16 itself and on the derrick of the drilling rig used to install the casing string 16.

Once the casing string 16 is installed, cementing operations require that the biased closed condition of the float shoe 42 be overcome. As illustrated in FIG. 3, once the float shoe valve member 46 is in the "open" position, fluid may flow from the interior of the casing string 16 and out the float shoe 42 into the wellbore 12. To open the valve member 46, cement is pumped downwardly through the casing string 16 and into the float shoe 42, downwardly biasing valve member 46 against the spring 44, and permitting flow between the disengaged valve member 46 and the valve seat 50. Fluid flows through the float shoe 42 by flowing through the inner spoke flow paths 40 as shown by multi-direction arrows B in FIG. 3.

During the cementing operation, whenever cement flow is stopped for any reason, the force of the hydrostatic pressure of wellbore fluids and cement below float shoe 42 as well as the spring 44 push the valve member 46 upwardly into contact with the annular body 31, thus re-establishing the seal between the plunger 49 and the valve seat 50. The valve plunger 49 is prevented from cocking in the body 31 by the valve stem 54 riding in the inner collar 36.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A casing shoe for a casing string, comprising:

an annular body comprising an annular recess forming an outer portion and an inner portion, the inner portion forming and extending into an inner bore, wherein the annular recess is adapted to accept an end of the casing string such that the casing string extends into the recess between the inner and outer portions, and wherein the annular body comprises a homogenous material.

2. The casing shoe of claim 1, wherein the inner portion further comprises:

an inner spoke extending into the inner bore; and an inner collar supported by the inner spoke.

3. The casing shoe of claim 2, wherein the annular body comprises a single, integral piece.

4. The casing shoe of claim 3, further comprising:

a valve member comprising:

a plunger;

a cap;

a valve stem extending through the inner collar and comprising a first end engaged with the plunger and a second end engaged with the cap; and a spring comprising a first end overlapping the inner collar and a second end retained by the cap;

wherein the body inner portion further comprises a valve seat, the spring biasing the plunger into sealing engagement with the valve seat.

5. The casing shoe of claim 4, wherein the valve member comprises a homogenous material.

6. The casing shoe of claim 1, wherein the annular recess comprises threads capable of engaging threads on the casing string.

7. The casing shoe of claim 1, wherein the homogenous material is non-metal.

8. The casing shoe of claim 1, wherein the homogenous material is non-steel.

9. The casing shoe of claim 1, wherein the homogenous material is non-cement.

10. The casing shoe of claim 1, wherein the homogenous material is plastic.

11. The casing shoe of claim 1, wherein the homogenous material is thermoplastic, or a thermoset.

12. The casing shoe of claim 1, wherein the homogenous material is non-corrosive.

13. The casing shoe of claim 12, wherein the homogenous material resists deterioration from wellbore fluids or gasses.

14. The casing shoe of claim 1 formed by at least one process selected from the group consisting of injection molding, thermal casting, thermal molding, and extrusion molding.

15. A casing shoe for a casing string, the casing shoe comprising:

an annular body comprising an annular recess defined by an outer portion and an inner portion and configured to receive a casing string, wherein the recess is substantially U-shaped in cross-section, and wherein the annular body comprises a single piece of homogenous material;

an inner spoke extending into an inner bore;

an inner collar supported by the inner spoke;

a valve member extending through the inner collar; and a spring biasing the valve member into sealing engagement with the annular body;

wherein the inner spoke and inner collar comprise a single piece of homogenous material; and wherein the valve member comprises a homogenous material.

16. The casing shoe of claim 15, wherein the annular body comprises:

an annular recess forming an outer portion and an inner portion, the inner portion forming and extending into an inner bore, and the annular recess adapted to accept an end of the casing string such that the casing string extends between the inner and outer portions;

wherein the annular recess comprises threads capable of engaging threads on the casing string.

17. A method of guiding a casing string into a wellbore, the method comprising:

attaching a casing shoe to an end of the casing string, the casing shoe comprising an annular body comprising an annular recess forming an outer portion and an inner portion, the inner portion forming and extending into an inner bore, the body comprising a single piece of homogenous material;

wherein attaching the casing shoe comprises inserting the end of the casing string into the annular recess such that the casing string extends between and engages the inner portion and the outer portion; and inserting the casing string into the wellbore.

18. A method of guiding a casing string into a wellbore, the method comprising:

attaching a casing shoe comprising an annular body comprising:

an annular recess defined by an outer portion and an inner portion and configured to receive a casing string;

wherein the recess is substantially U-shaped in cross-section, and wherein the annular body comprises a single piece of homogenous material attached to an end of the casing string, wherein the casing shoe further comprises:

an inner spoke extending into an inner bore;

an inner collar supported by the inner spoke;

a valve member extending through the inner collar; and a spring biasing the valve member into sealing engagement with the annular body;

wherein the inner spoke and inner collar comprise a single piece of homogenous material, and wherein the valve member comprises a homogenous material; and inserting the casing string into the wellbore.

19. The method of claim 18, wherein the wellbore is shallow.

20. The method of claim 18, wherein the wellbore has a low bottom hole temperature.

21. The method of claim 20, wherein the bottom hole temperature is less than about 200 degrees Fahrenheit.

22. The method of claim 18, wherein the cashing shoe is subjected to a maximum force of less than about 75,000 pounds while being inserted in the wellbore.

23. The method of claim 18, wherein the homogenous material is non-corrosive.

24. The method of claim 23, wherein the homogenous material resists deterioration from wellbore fluids or gasses.

* * * * *

UNITED STATES PATENT AND TRADEMARK OFFICE

CERTIFICATE OF CORRECTION

PATENT NO. : 7,617,879 B2
APPLICATION NO. : 11/559503
DATED : November 17, 2009
INVENTOR(S) : Anderson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 165 days.

Signed and Sealed this

Nineteenth Day of October, 2010

David J. Kappos

David J. Kappos
*Director of the United States Patent and Trademark Office*